US006561232B1

(12) United States Patent
Frutin

(10) Patent No.: US 6,561,232 B1
(45) Date of Patent: May 13, 2003

(54) BOTTLE CLOSURE HAVING MEANS FOR MIXING A PREDETERMINED DOSE OF AN ADDITIVE INTO A LIQUID

(75) Inventor: Bernard Derek Frutin, Scotland (GB)

(73) Assignee: Rocep Lusol Holdings Limited, Renfrew (GB)

( * ) Notice: Subject to any disclaimer, the term of this patent is extended or adjusted under 35 U.S.C. 154(b) by 0 days.

(21) Appl. No.: 09/830,705

(22) PCT Filed: Oct. 28, 1999

(86) PCT No.: PCT/GB99/03569

§ 371 (c)(1),
(2), (4) Date: Aug. 20, 2001

(87) PCT Pub. No.: WO00/26107

PCT Pub. Date: May 11, 2000

(30) Foreign Application Priority Data

| | | |
|---|---|---|
| Oct. 29, 1998 | (GB) | 9823578 |
| Jun. 22, 1999 | (GB) | 9914414 |
| Jul. 3, 1999 | (GB) | 9915487 |

(51) Int. Cl.[7] ..... B65B 3/04

(52) U.S. Cl. ..... 141/9; 141/5; 141/67; 141/100; 141/112; 141/330; 141/364; 141/363; 206/222; 220/501

(58) Field of Search ..... 141/4, 5, 9, 35, 141/67, 100, 112, 329, 330, 363, 364, 366; 206/219, 222; 220/501; 215/DIG. 8

(56) References Cited

U.S. PATENT DOCUMENTS

| | | | | |
|---|---|---|---|---|
| 4,741,437 A | * | 5/1988 | Gorski et al. | 206/222 |
| 5,196,216 A | * | 3/1993 | Lynch et al. | 426/112 |

FOREIGN PATENT DOCUMENTS

| | | | |
|---|---|---|---|
| DE | 2 157 492 | 5/1973 | B65D/25/08 |
| DE | 86 24 487.6 | 2/1988 | B65D/81/32 |
| EP | 0 140 446 A2 | 5/1985 | B65D/35/50 |
| EP | 0 591 601 A1 | 4/1994 | B65D/47/20 |
| GB | 821914 | 10/1959 | |
| WO | 97/05039 | 2/1997 | B65D/81/32 |
| WO | 97/21605 | 6/1997 | B65D/51/28 |

OTHER PUBLICATIONS

Search Report from PCT/GB99/03569, dated Feb. 15, 2000.

* cited by examiner

*Primary Examiner*—Timothy L. Maust
(74) *Attorney, Agent, or Firm*—Moser, Patterson & Sheridan, L.L.P.

(57) ABSTRACT

The invention relates to an apparatus for introducing an additive component (131) in the form of a liquid or granulated solid into a liquid (40) stored in a first container (150). The additive component (131) is stored separately from the liquid (40) in a dip tube or conduit (132). The container (150) has an opening closed by a releasable closure (152). A second container or tank (111) containing pressurized propellant fluid (116) is positioned in the neck or closure of the first container, adjacent to the opening. The dip tube or conduit (132) has a first end communicating with the tank and a second end extending down into the first liquid in the first container. The dip tube (132) contains an additive (131) which is expelled from the dip tube into the first liquid by the entry of the propellant fluid from the tank into the dip tube on release of the releasable closure. A valve (300) may be provided at the free end of the dip tube (132) to prevent mixing of the liquid and additive during transport and/or storage. The dose of additive may be accurately measured, and the action of the propellant ensures that all the additive is expelled into the liquid. The additive may be provided in liquid or pourable solid form.

21 Claims, 9 Drawing Sheets

BOTTLE CLOSURE HAVING MEANS FOR MIXING A PREDETERMINED DOSE OF AN ADDITIVE INTO A LIQUID

The invention relates to apparatus for introducing an additive in the form of a liquid or granulated solid into a liquid and more particularly to a container which automatically adds the additive to the liquid on opening of the container.

In a wide number of applications, such as pharmaceuticals for both human and animal use, agrochemicals and other more general applications it may be necessary to release and mix a liquid catalyst or reagent into a liquid before the liquid may be used. Conventional methods involve a user measuring out the liquid catalyst or reagent and then adding it to the main liquid. This may cause problems in that it is prone to human error in the measuring of the amount of liquid catalyst or reagent and may also be hazardous if the catalyst or reagent is toxic.

International Patent Application No PCT/GB96/01803 discloses an apparatus for introducing a fluid into a first liquid comprising a first container (for example a bottle) which contains the first liquid, a bottle top and a second container attached to the underside of the bottle top to form a cap assembly. The second container contains a fluid under pressure. When the bottle top is placed on the bottle the fluid in the second container expands and drives a membrane onto a rupturing spike. The fluid is then released from the second container to the liquid in the bottle.

A disadvantage of the known apparatus is that if the fluid is a dye, for example, there remain residues of the dye on the underside of the cap assembly, since the propellant gas in the second container does not drive out every drop of fluid. Some fluid remains behind the ruptured foil. This means that care must be taken with the cap assembly so that dye is not transferred to clothing, table tops etc.

A further disadvantage of the known apparatus is that the dose of fluid delivered by the apparatus is inaccurate. The second container is filled with the fluid under pressure, and after release an unknown volume of fluid remains in the container and in the dip tube connector, as well as in the dip tube if a dip tube is used.

A further disadvantage of the known apparatus is that it can only be used with fluids and liquids which can be readily expelled through the small ruptured aperture.

A further disadvantage of the known apparatus is that it can only be used to add one component to the liquid.

It is an object of the present invention to provide an apparatus which overcomes one or more of the above disadvantages.

According to a first aspect of the present invention there is provided an apparatus for introducing a component into a first liquid, the apparatus comprising:

a first container for holding the first liquid having an opening closed by a releasable closure, a second container located in the first container, and a conduit having a first end communicating with the second container and a second end communicating with the first container;

wherein the conduit contains an additive which is expelled from the conduit into the first liquid by the entry of the propellant fluid into the conduit on release of the releasable closure.

The conduit forms a dip tube, which serves the purpose of storing the additive product until it is fired by pressure of propellant from the tank or second container into the first liquid in the first container.

Preferably the second container comprises an outer housing and an inner container containing a propellant fluid, the inner container being movably mounted in the housing for movement between a closed position in which the inner container is sealed by the housing when the releasable closure closes the opening, and an open position in which the propellant fluid within the inner container is released from the inner container into the conduit on release of the releasable closure.

Preferably the second container is located adjacent to the opening in the first container.

Preferably the inner container includes a rupturable member and the housing includes a rupturing member to rupture the rupturable member on the inner container.

Preferably on closing of the first container by the closure, the inner container is moved to the closed position and the second container includes a sealing device and when the inner container is in the closed position, the rupturable member is ruptured by he rupturing member and the contents of the inner container prevented from being released from the inner container by the sealing member.

Preferably the sealing member is mounted on the inner container and seals against the rupturing member on the housing.

Preferably the rupturable member includes a fluid port is through which the fluid passes when the second container moves to the open position.

Preferably the conduit extends below the surface of the first liquid in the first container. Alternatively the conduit may extend to a position close to the wall of the first container above the surface of the first liquid, to avoid foaming of the liquid and the creation of pressure waves in the liquid. The first container may be a bottle having a neck, and the conduit may extend to a position adjacent to the wall of the neck.

The propellant fluid may comprise a gas or a gas/liquid mixture. Preferably the propellant fluid is pressurized, to aid expulsion of the fluid from the second container on release of the closure. Typically, where the second container comprises an outer housing and an inner container, pressurized gas is located in the inner container with the second liquid.

An advantage of the invention is that it is possible to introduce the additive into the first liquid without requiring direct handling of the propellant fluid or the additive by a user.

The conduit may contain a number of additives arranged at different positions along the length of the conduit. The additives may be liquid or solid in pourable form, such as powders or granules. The additives may be coloring agents, flavoring agents, fragrances, pharmaceutical components, chemicals, nutrients, liquids containing gases in solution etc.

The apparatus may comprise two or more conduits, each having a first end communicating with the second container and a second end communicating with the first container. Each conduit may contain a corresponding additive. The conduits may be of different lengths and/or cross-sectional areas. In this way a number of additives in different doses may be added to the liquid. If the dimensions of the conduit are accurately known, then the doses will be accurate.

The or each conduit may be provided with a one-way valve at the end of the conduit remote from the second container.

According to a second aspect of the present invention there is provided an apparatus for introducing a component into a first liquid, the apparatus comprising:

a first container for holding the first liquid having an opening closed by a releasable closure;

a releasable closure adapted to close said opening; and an insert located adjacent to said opening;

wherein said first chamber is provided with openings to allow the passage of said first liquid through said insert;

wherein the releasable closure comprises an integral closure container containing a propellant fluid;

wherein said insert comprises a first chamber for receiving said integral closure container and a hollow rupturing member extending into said first chamber and defining a second chamber inside said rupturing member;

wherein said closure container includes a rupturable member adapted to be ruptured by said rupturing member; and wherein the apparatus further comprises a conduit having a first end communicating with the second chamber and a second end communicating with the first container, the conduit containing an additive which is expelled from the conduit into the first liquid by the entry of the propellant fluid into the conduit on release of the releasable closure.

The conduit or dip tube stores the additive product until it is fired by pressure of the propellant in the integral closure container or tank, and is forced out of the dip tube into the first liquid in the first container.

Preferably said closure container comprises a substantially tubular wall portion extending from said closure and a cap member sealingly fitted to said wall portion to form said closure container, wherein said cap member comprises said rupturable member.

Preferably on closing of the first container by the closure, the closure container is moved towards the rupturing member, such that when the closure container is in the closed position, the rupturable member is ruptured by the rupturing member and the contents of the closure container are prevented from being released from the closure container by the sealing action between the rupturing member and the cap member.

Preferably the cap member comprises a flange portion adapted to engage with the free end of the tubular portion of the closure member, by a rib and groove snap fit or similar. Preferably the cap member comprises a cylindrical bore portion adapted to receive and sealingly engage with a cylindrical portion of the rupturing member. Preferably the cylindrical bore portion is provided with upper and lower sealing ribs adapted to sealingly engage with the rupturing member.

Preferably the rupturing member includes one or more fluid ports through which the fluid passes when the closure container is moved away from the rupturing member on removal of the removable closure. Preferably said fluid ports are radial ports positioned such that in the closed portions the ports are located between the upper and lower sealing ribs of the cap member. Preferably the ports are positioned such that the distance between the ports and the upper end of the cylindrical portion of the rupturing member is less than the distance between the upper and lower sealing ribs, so that on removal of the removable closure the seal between the upper sealing rib and the cylindrical portion of the rupturing member is broken before the ports pass the lower sealing rib.

The preferred form of conduit or dip tube is a polypropylene tube of circular cross-section, typically having an internal diameter of 5.8 mm. Such a tube has an internal capacity of 0.26 ml for each 10 mm length, so an 80 mm long tube can hold approximately 2 ml of product. The tank typically has a capacity of 2 ml, and contains pressurized propellant gas.

When the tank is of an impermeable material such as metal, then the headspace required for the propellent gas is only a proportion of the total tank volume, leaving the remainder of the tank volume available for product.

However when the tank is of a material such as plastic which exhibits long term permeability, then the headspace required for the propellent gas must be maximised, and none of the tank volume is available for product. In such cases it can be necessary to use larger diameter dip tubes capable of holding more product, and there may then a need for a valve arrangement at the lower end of the dip tube so that product does not drip into the first liquid in the first container. The use of small diameter dip tubes such as capillary tubes avoids the need for valves, but such small diameter dip tubes can only hold a small amount of product.

The invention therefore also provides a simple, inexpensive valve arrangement which prevents the product in a dip tube from leaking or dripping into the first liquid in the first container when the dip tube and first container are at the same pressure, but which allows the passage of liquid or pourable solid product from the dip tube into the first liquid in the first container when the dip tube is pressurized by introduction of the propellant fluid. It should be emphasised that such a valve arrangement will not always be required.

Preferably the apparatus according to the first or second aspect of the invention is provided with a valve at the second end of the conduit member.

According to a first preferred embodiment the valve comprises an expandable tubular member and a sleeve member surrounding at least a portion of said expandable tubular member, wherein the expandable tube member has a closed end and at least one aperture therein adapted to permit the expulsion of fluid under pressure from the expandable tube member, and is expandable between a first unexpanded state in which the aperture is closed by contact with either the sleeve or a part of the expandable tubular member and a second expanded state in which the aperture is open.

Preferably the expandable tubular member is of plastic, most preferably of polypropylene. Preferably the sleeve is of plastic, most preferably of polypropylene. Preferably the tubular member and sleeve are both of circular cross-section.

Preferably the expandable tubular member comprises a corrugated portion adapted to concertina between said unexpanded and expanded states. Preferably said corrugated portion comprises a plurality of concertina-like ribs, each rib comprising a length of tube of increasing cross-sectional area and a length of tube of decreasing cross-sectional area. Preferably said sleeve comprises an inwardly directed flange at its upper end remote from the closed end of the expanded tubular member, adapted to engage with a corrugated portion of the expanded tubular member.

There may be provided more than one aperture, arranged circumferentially around the expandable tubular member.

According to a first aspect of the first preferred embodiment the aperture is provided in a concertina-like rib of said corrugated portion, most preferably in the lower rib adjacent to the closed end of the expandable tubular member. Preferably the lower rib is of larger external diameter than the upper ribs and is adapted to seal against the internal surface of the sleeve. Preferably the closed end of the expandable tubular member is formed by heat sealing.

According to a second aspect of the first preferred embodiment the aperture is provided in a uniform diameter portion of the expandable tubular member. Preferably the sleeve comprises an upper portion of larger diameter which fits around the corrugated portion of the expandable tubular member and a lower portion of smaller diameter which fits sealingly around the uniform diameter portion of the expandable tubular member. Preferably the closed end of the expandable tubular member is formed by an insert, preferably a concave insert, fixed inside the tubular member below the aperture.

According to a second preferred embodiment the valve comprises an expandable tubular member, as in the first preferred embodiment, but the sleeve member is omitted. In this case the resilience of the material of the expandable tubular member causes it to remain in the unexpanded state so that the aperture is closed by contact with a part of the expandable tubular member until internal pressure is applied to the expandable tubular member.

According to a third preferred embodiment the valve comprises a hollow tubular member having a flattened end portion of resilient plastics material, the flattened end portion comprising two opposing walls held in contact with each other by the resilience of the plastics material and adapted to move out of contact with each other when the hollow tubular member is subject to internal pressure.

Preferably the flattened end portion is formed by applying heat to the tubular member. Preferably the heat is sufficient to cause plastic deformation of the material, but not sufficient to cause melt bonding of the opposing walls.

The two opposing walls may be substantially planar. Alternatively the two opposing walls may be arcuate in transverse section, the outer surface of a first one of the opposing walls being in contact with the inner surface of the second one of the opposing walls.

The flattened end portion may comprise one or more transverse folds. Alternatively the flattened end portion may be curved or bent about a transverse axis. The flattened end portion may be rolled about a transverse axis.

Preferably the tubular member is of plastic, most preferably of polypropylene. Preferably the tubular member is of circular cross-section.

According to a third aspect of the invention there is provided a method of introducing an additive in the form of a liquid or granulated solid into a liquid, comprising introducing a predetermined quantity of the additive into a conduit at least partially closed at one end, installing the conduit in a vessel containing a liquid, closing the vessel, and triggering a pressure release apparatus upon opening the vessel, thereby forcing propellant into the open end of said conduit and expelling the additive from the partially closed end of the conduit into the liquid.

Preferably the method uses the apparatus according to the first or second aspects of the invention.

Examples of apparatus in accordance with the invention will now be described with reference to the accompanying drawings, in which FIG. 1 is a cross-sectional view of a first example of a second container in a shipping or storage position;

Figure 9:
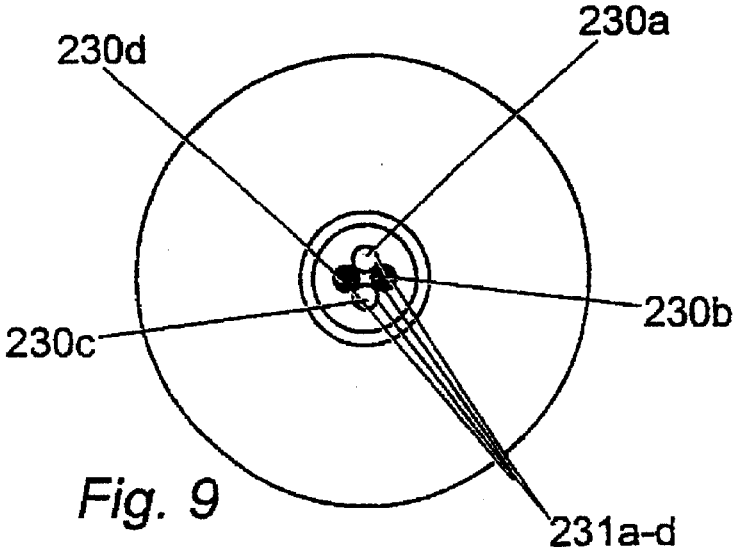
Figures 5A, 5B, 5C, 5D, 5E:
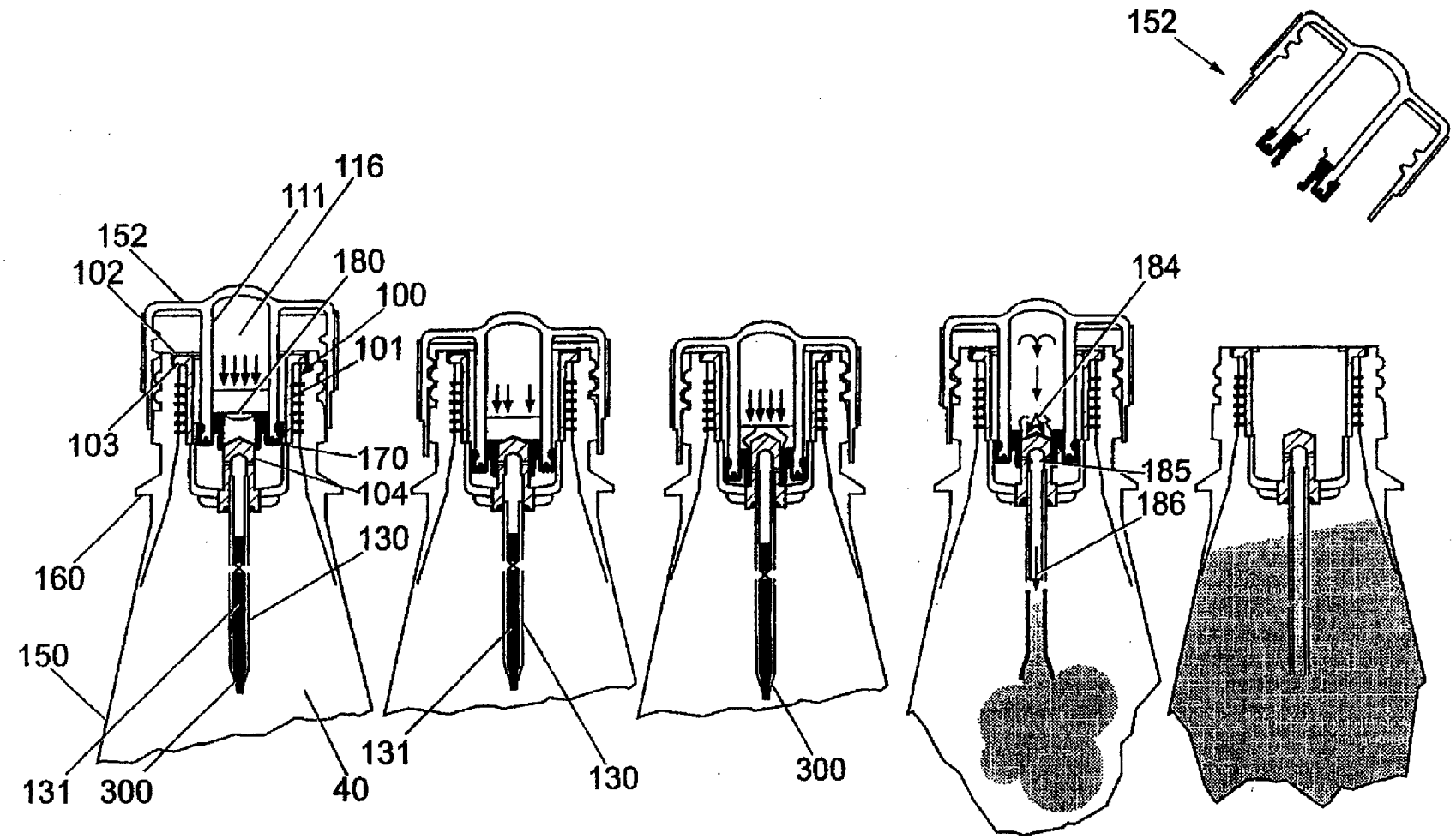
Figure 7:
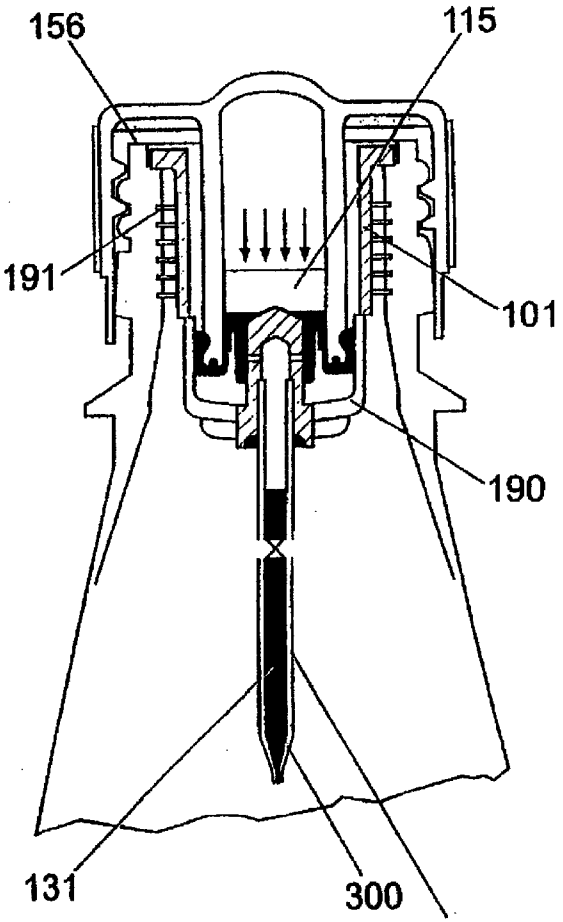
Figure 6:
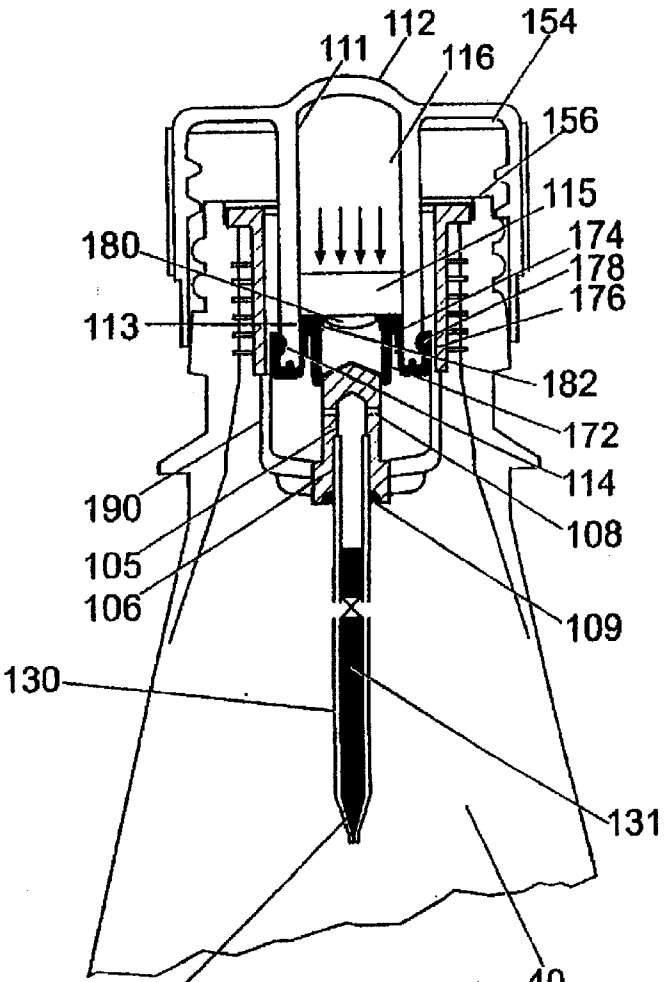
Figures 8A, 8B, 8C, 8D, 8E:
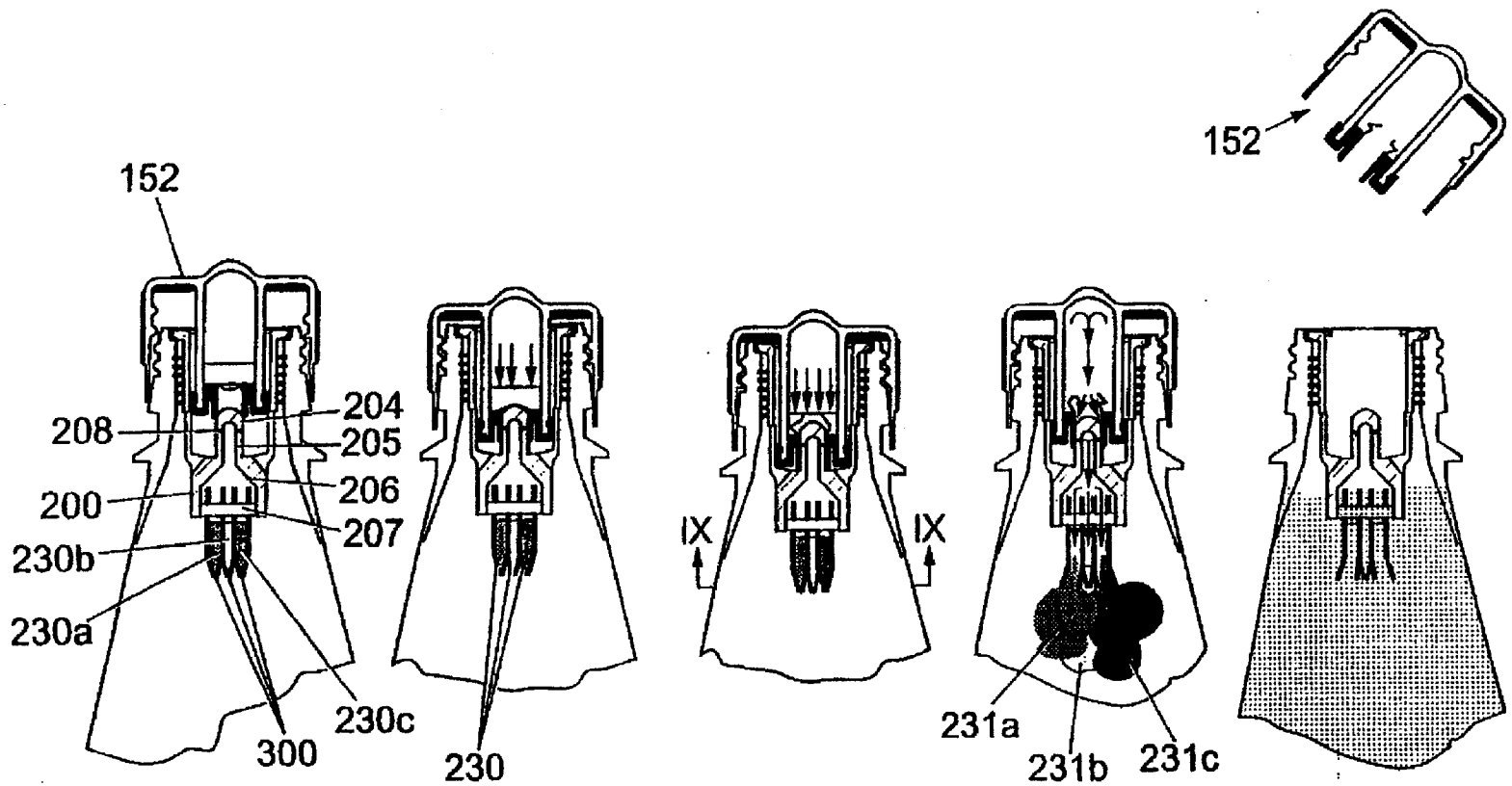

FIGS. 5*a* to 5*e* are cross-sectional views of a third embodiment of the invention, in which the second container is integrally formed in a bottle top, showing the top before screwing on, during screwing on, screwed on tight, during release and fully removed respectively;

FIG. 6 is a cross-sectional view of the embodiment of FIG. 5*a* to an enlarged scale;

FIG. 7 is a cross-sectional view of the embodiment of FIG. 5*b* to an enlarged scale;

FIGS. 8*a* to 8*e* are cross-sectional views of a fourth embodiment of the invention, in which the second container is integrally formed in a bottle top and includes a plurality of dip tubes, showing the top before screwing on, during screwing on, screwed on tight, during release and fully removed respectively;

FIG. 9 is a cross-sectional view on line IX—IX in FIG. 8*c;*

Figure 10:
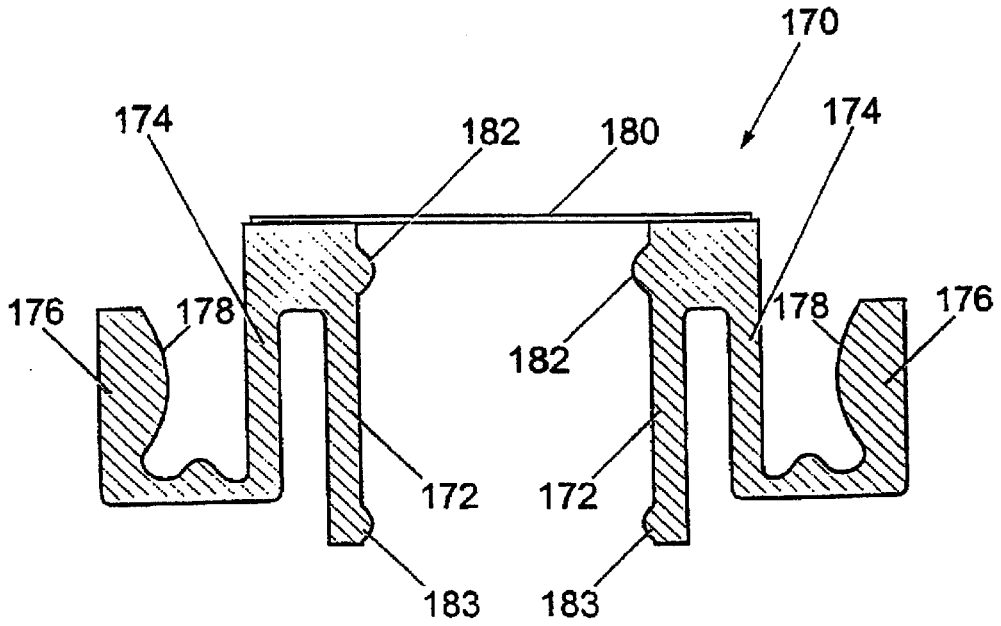
Figure 11:
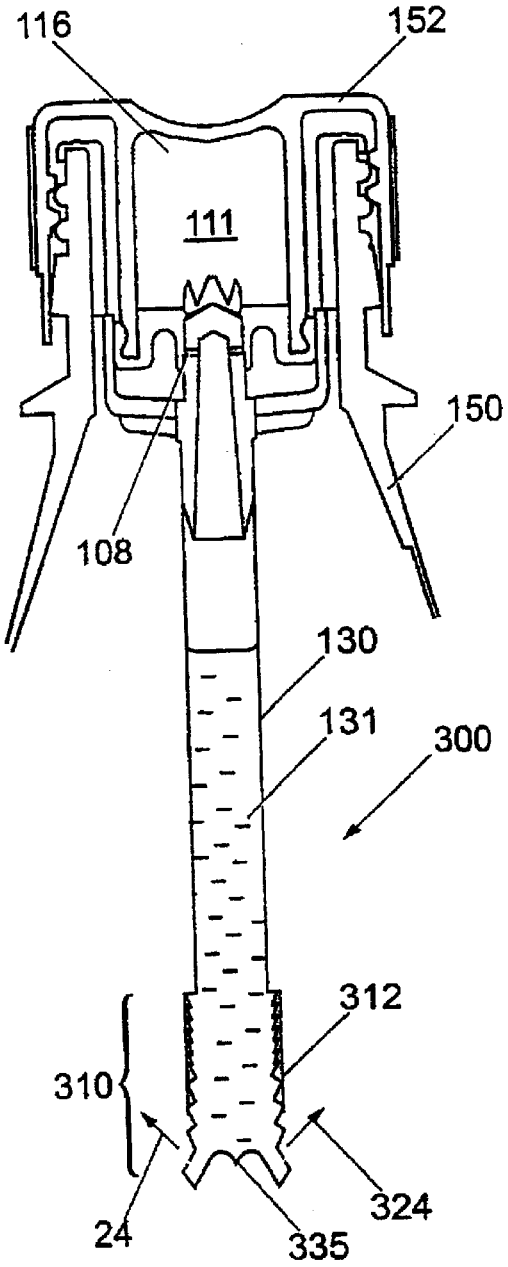
Figure 12:
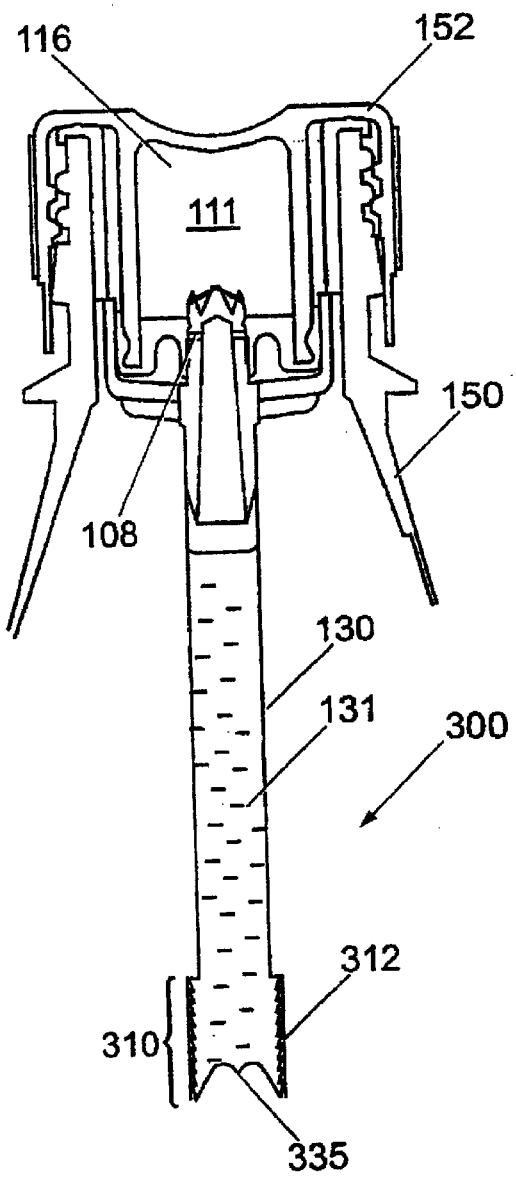
Figure 16:
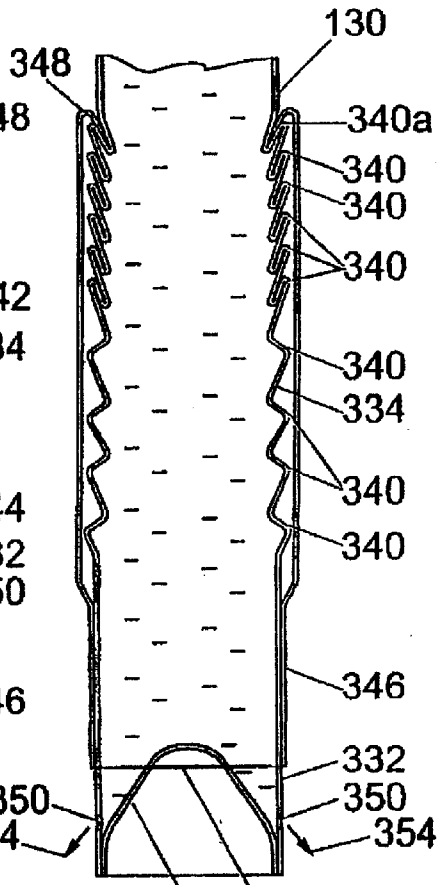
Figure 15:
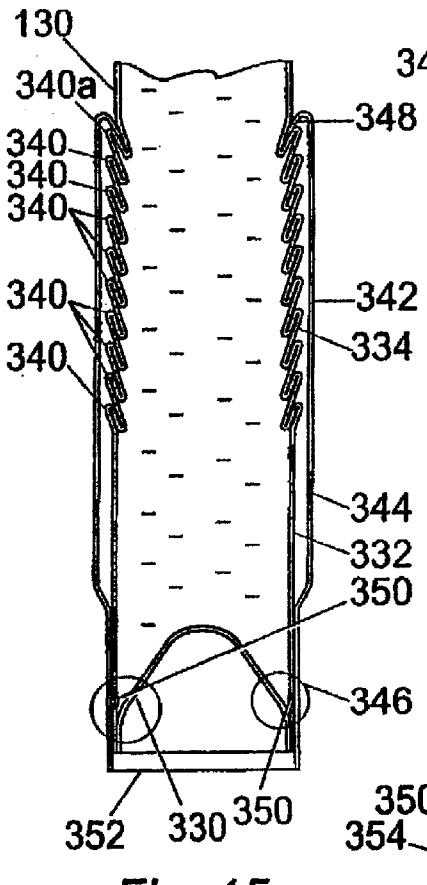
Figure 14:
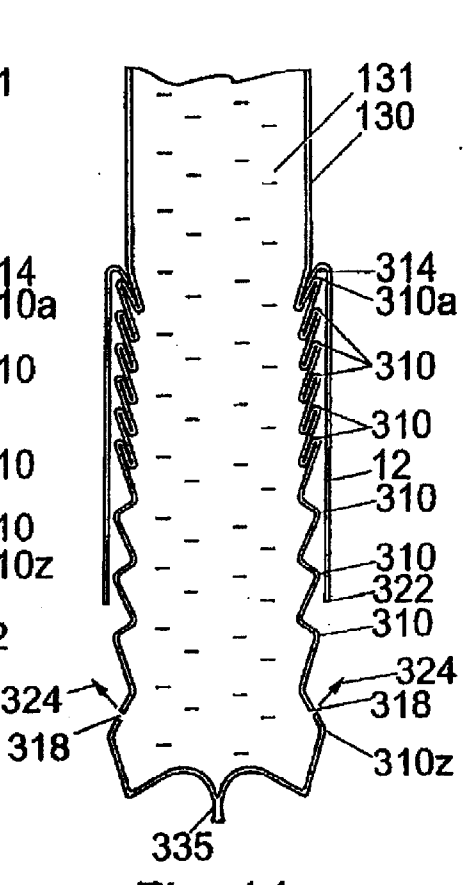
Figure 13:
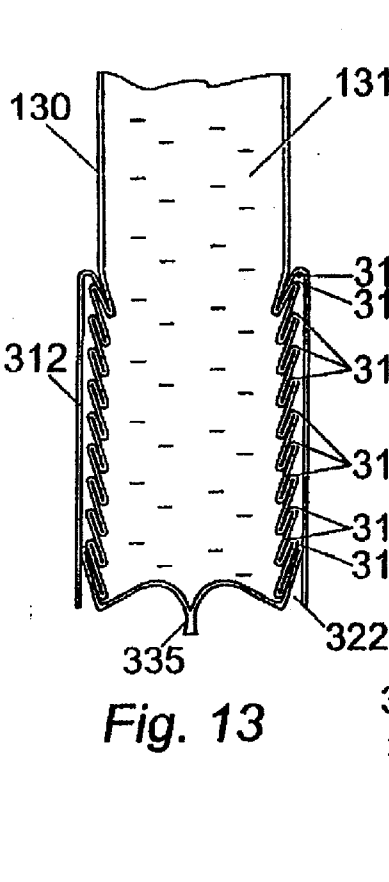
Figure 18:
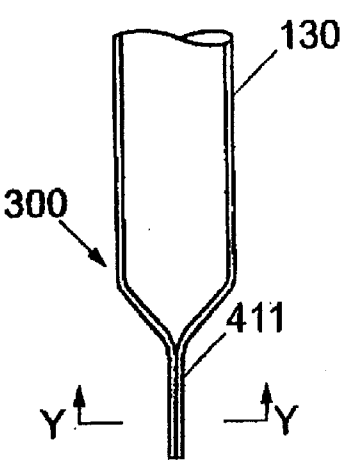
Figure 17:
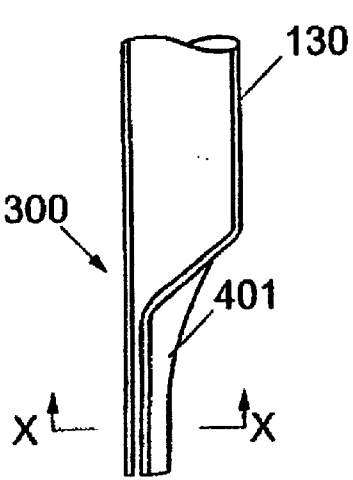
Figure 18A:
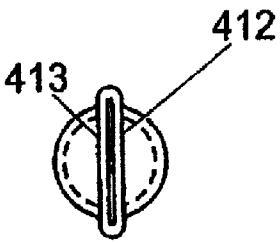
Figure 17A:
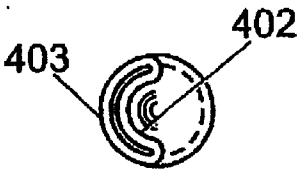

FIG. 10 is an enlarged sectional view through the plastic ferrule of the invention;

FIG. 11 is a cross-sectional view of the embodiment of FIG. 5*d* showing a first embodiment of a dip tube valve of the invention in its expanded or open state;

FIG. 12 is a cross-sectional view of the embodiment of FIG. 5*c* showing the first embodiment of a dip tube valve of the invention in its contracted or closed state;

FIG. 13 is a cross-sectional view through the valve of FIG. 12 in its contracted or closed state;

FIG. 14 is a cross-sectional view through the valve of FIG. 11 in its expanded or open state;

FIG. 15 is a cross-sectional view through a second embodiment of a dip tube valve of the invention in its contracted or closed state;

FIG. 16 is a cross-sectional view through the valve of FIG. 15 in its expanded or open state;

FIG. 17 is a longitudinal cross-sectional view through a third embodiment of the dip tube valve of the invention in its closed state;

FIG. 17*a* is a section on line X—X through the valve of FIG. 17;

FIG. 18 is a longitudinal cross-sectional view through a fourth embodiment of the dip tube valve of the invention in its closed state;

FIG. 18*a* is a section on line Y—Y through the valve of FIG. 18; and

Figure 21:
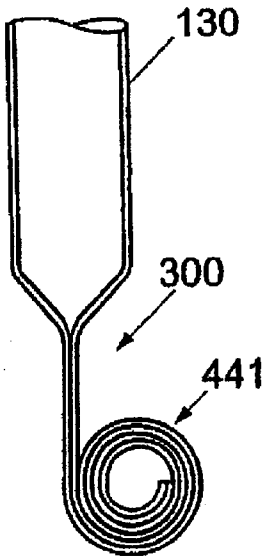
Figure 20:
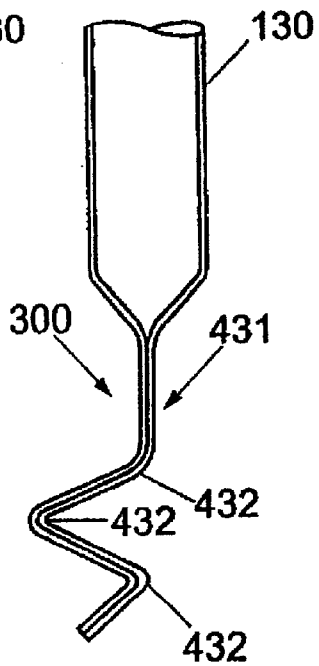
Figure 19:
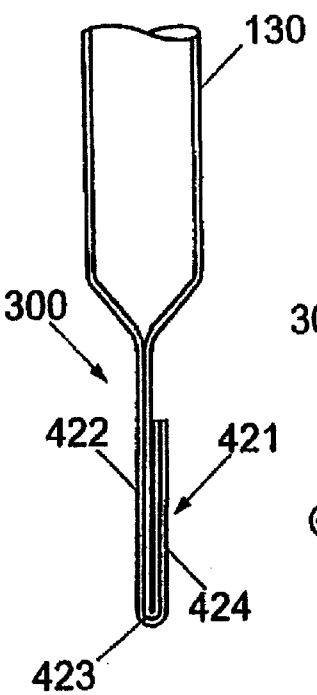

FIGS. 19 to 21 are longitudinal cross-sectional views through fifth, sixth and seventh embodiments respectively of the dip tube valve of the invention in its closed state.

Figure 1:
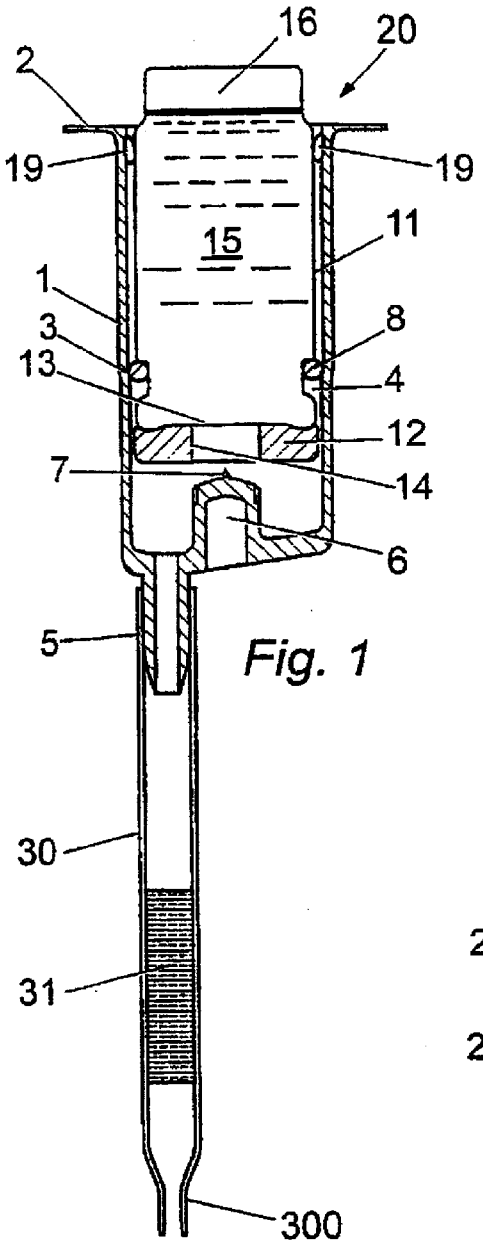

FIG. 1 shows a second container 20 which comprises an outer housing 1 which has an upper lip 2. Extending from the bottom of the housing 1 is a dip tube connector 5. Attached to the dip tube connector 5 is a dip tube or conduit 30. The housing 1 has a rupturing member 6 which extends upwards and terminates in a spike 7.

In the side wall of the housing 1 is a ridge 3 which extends circumferentially around the inside of the housing 1.

An inner container 11 has a lower open end which is sealed by a sealing gasket 12 and a rupturable membrane 13. The gasket 12 is annular and defines a central aperture 14. The container 11 also has an O-ring seal 8 encircling it in a circumferential recess 4 in the container 11.

In use, the inner container 11 is filled with a liquid 15 and a pressurized gas 16 by means of conventional technology used to fill pressurized dispenser packs, commonly known as aerosol containers. The inner container 11 is then inserted into the outer housing 1 and pushed into the outer housing 1 until the O-ring 8 engages with the ridge 3. This position is shown in FIG. 1. In this position the membrane 13 is above the member 6 and spike 7. Alternatively the inner container 11 may be filled solely with pressurized gas 16, omitting the liquid is.

Figure 4:
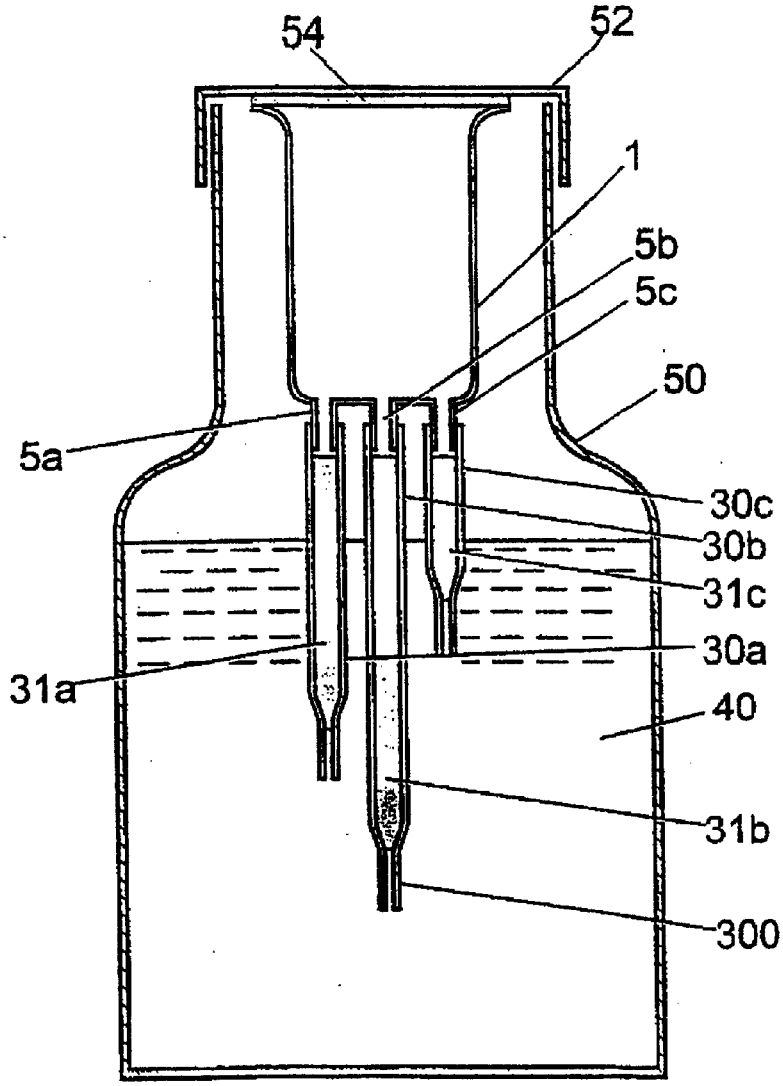
FIG. 4 is a schematic cross-sectional view of a second example of an apparatus according to the invention.

The outer housing 1 and the inner container 11 are then inserted into the opening of a container 50, the outer housing 1 fits inside the opening and the dip tube 30 extends into a first liquid 40 in the container 50 (as shown in FIG. 4). The outer housing 1 is supported in the opening by the upper lip 2 which rests on the top of the opening. A closure 52 such as a threaded cap is then applied to the container 50 to close the container. On application of the closure 52 to the first container 50, the inner container 11 is moved downwards and moves to the position shown in FIG. 2. An adhesive section 54 may be provided on the top end of the container 11 and serves to attach the top end of the container 11 to the inside of the closure 52 when the closure is applied to the container S50

Figure 2:
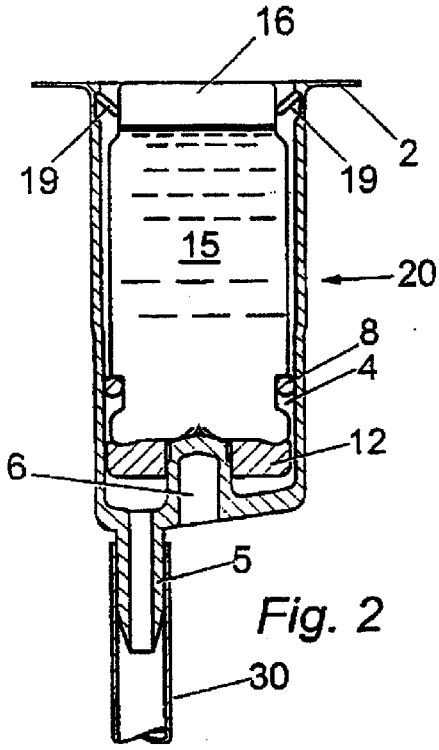
FIG. 2 is a cross-sectional view of the second container of FIG. 1 showing the position of the second container when located in a first container and the first container opening is closed.

When the closure 52 is applied to the first container 50, the inner container 11 moves to the position shown in FIG. 2. When this happens, the spike 7 bursts the rupturable membrane 13 and the member 6 extends into the aperture 14 in the gasket 12. In this position the liquid 15 and gas 16 are prevented from escaping from the inner container 11 by the gasket 12 and member 6 which seal against each other to prevent release of the liquid 15 and gas 16 from the container 11.

The inner container 11 remains in the position shown in FIG. 2 until a user releases the closure 52 from the first container 50. When this occurs, the inner container 11 moves to the position shown in FIG. 3. In this position the gasket 12 becomes unsealed from the member 6 and liquid 15 (or gas 16) is forced out of the container 11 by the pressurized gas 16 through grooves 18 in the member 6 in the direction of arrows 17 and into the dip tube connector 5. The liquid 15 then passes through the dip tube 30, expelling the additive material 31 in the dip tube 30 into the first liquid 40 in the first container. On removal of the closure 52, the housing 1, inner container 11 and dip tube 30 are removed from the first container 50 because the inner container 11 is attached to the closure 52 by adhesive 54, and the housing is attached to the inner container by the non-return detent tabs 19. The liquid 15 enters the first liquid through the dip tube connector 5 and dip tube (if fitted) before the housing 1, inner container 11 and dip tube (if fitted) are removed from the first container. Liquid is prevented from passing up between the housing 1 and the inner containers 11 by the O-ring 8.

Figure 3:
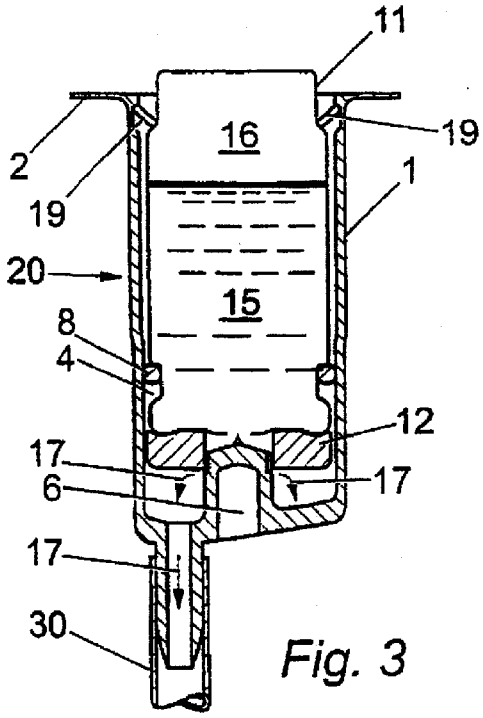
FIG. 3 is a cross-sectional view of the second container of FIG. 1 showing the position of the second container when the closure on the first container is released.

It is possible that upward movement of the container 11 from the position shown in FIG. 2 to the position shown in FIG. 3 could be aided by a spring located between the gasket 12 and the bottom of the outer housing 1.

Hence, the container 11 may move to the position shown in FIG. 3 by use of a spring and/or by means of the pressure within the container 11 which reacts against the member 6 to push the inner container 10 to the position shown in FIG. 3.

A second example of the apparatus of the invention is shown in FIG. 4. The housing 1 is the same as that shown in FIGS. 1 to 3, with the exception that it is provided with three dip tube connectors 5*a*, 5*b*, 5*c*, each connected to a corresponding dip tube or conduit 30*a*, 30*b*, 30*c*. The conduits, typically comprising polypropylene drinking straws or similar, may be of different diameter or length and may contain different predetermined doses of additives 31*a*, 31*b*, 31*c*. The lower end of the conduit is provided with a one way valve 300 such as a valve described below with reference to FIGS. 11 to 21 to prevent the additive 31 reaching the liquid 40 until the pressurized propellant in the second container 11 is released. It is found that if the liquid propellant 15 is omitted, then a pure gas propellant will drive a powdered additive 31 into the liquid 40 without leaving any additive in the conduit 30. If desired a number of different additives 31 may be provided in one conduit, so that they are expelled to different levels in the liquid.

In the examples described above, the inner containers may be secured to the cap of the first container, for example, by putting blown polyethylene foam on the upper end of the inner containers and welding the blown polyethylene foam to blown polyethylene foam on the inside top of the cap of the first container by ultrasonic welding. Other possibilities include friction fitting the inner container to a hollow cap which is then secured to the inside of the cap of the first container.

The embodiments of FIGS. 1 to 4 offer the advantages of accurate dosage, and the ability to use granular as well as liquid additives. It can add several components at the same time. However it does not completely solve the problem of concentrate residues remaining on the underside of the cap assembly, since the whole dip tube assembly must be removed from the cap, and residues may remain on the dip tube. This problem is addressed by the embodiments shown in FIGS. 5 to 10, since in these embodiments the dip tube remains in the container after removal of the closure.

FIGS. 5*a* to 5*e* show another embodiment of the invention in which the second container is integrally formed with a screw top which is then screwed onto a bottle or first container, in the neck of which is secured an insert which has a rupturing spike and a dip tube.

FIG. 5*a* shows a bottle 150 having an insert 100 secured within the neck 160 of the bottle, shown in more detail in FIG. 6. The screw cap 152 is shown separately, before closure of the bottle 150. The cap 152 has an internal thread to mate with the external thread on the neck 160 of the bottle. The cap has an integrally molded cylindrical portion which forms an inner container 111, which is closed at the upper end by a convex portion 112 of the cap 152, so as to resist internal pressure in the inner container, and is open at the lower end 113. A circumferential groove 114 is provided externally at the lower end 113 of the inner container 111.

A plastic ferrule 170, shown in more detail in FIG. 10, comprises an inner cylindrical wall 172 forming a chamber which is open at its lower end and closed by a foil seal or membrane 180 at its upper end. The inner cylindrical wall 172 is connected and sealed at its upper end to an outer cylindrical wall 174, whose outside diameter is selected to fit tightly within the inside diameter of the inner container 111. At the lower end of the outer cylindrical wall 174 is provided a return flange 176 which has a circumferential rib 178 adapted to cooperate with the groove 114 on the outside wall of the inner container 11. The inner wall 172 has upper and lower sealing ribs 182, 183 which are adapted to provide a pressure resistant seal against the outer surface of the rupturing member 104.

The ferrule 170 is secured by a snap fit to the lower end 113 of the inner container 111, to provide a pressure resistant closure to the container. The inner container is filled with liquid 115 and pressurized gas 116 in a conventional fashion, so that the inner container is under internal pressure, causing the foil seal 180 to bow outwards.

An insert 100 is secured by any suitable means within the neck 160 of the bottle 150. The insert 100 comprises a substantially cylindrical housing 101 open at the upper end and having a number of legs 190 projecting from the lower end. The housing is provided with detent members 191 which engage with the inside of the neck 160 of the bottle, so that the insert 100 cannot be readily removed. The upper end of the housing has a lip 102 which is adapted to engage with a recess 103 in the neck 160 of the bottle, to prevent the insert from being pushed down inside the neck.

The legs 190 are connected at their lower end to a hollow spike member 104, which has a small diameter bore portion 105 at its upper end and a large diameter bore portion 106 at its lower end. Between the legs are apertures which allow the passage of liquid between the spike member 104 and the side of the bottle when the liquid is poured from the bottle. The number of legs and intervening apertures may be two, three, four or more as appropriate.

Within the wall of the small diameter bore portion 105 are provided a number of radial passages 108 which communicate with the hollow interior of the spike 104 and the interior of the housing 101. Extending from the bottom of the hollow rupturing member 104 is a dip tube or conduit 130, surrounded by a plastic or sprung steel cone washer 109 which is secured to the rupturing member 104 and serves as a one-way retaining member to allow the conduit 130 to be inserted up into the large diameter bore 106 but to restrain it from being removed in a downwards direction. The large diameter bore portion 106 has an internal diameter equal to the external diameter of the dip tube 130. The step between the large and small diameter bore portions 105, 106 prevents the dip tube 30 extending into the small diameter bore portion 105 and blocking the radial apertures 108.

In use, the inner container 111 is filled with a liquid 115 and a pressurized gas 116 by means of conventional technology used to fill pressurized dispenser packs, commonly known as aerosol containers. Alternatively the inner container 111 may be filled solely with pressurized gas 116, omitting the liquid 115.

FIG. 5*b* shows the cap 152 while it is being screwed on to the neck 160, shown in more detail in FIG. 7. On application of the closure or cap 152 to the bottle 150, the inner container 111 is moved downwards and the spike 104 enters the space formed by the inner cylindrical wall 172 of the ferrule 170.

When the closure 152 is fully screwed tight on to the bottle 150, the inner container 111 moves to the position shown in FIG. 5*c*, in which the seal member 154 inside the cap 152 seals tightly against the top 156 of the bottle neck 160. When this happens, the spike 104 bursts the rupturable membrane 180 and the member hollow spike extends into the inner container 111. In this position the liquid 115 and gas 116 are prevented from escaping from the inner container 111 by the ferrule 170 and spike member 104 which seal against each other to prevent release of the liquid 115 and gas 116 from the container 111. The upper sealing rib 182 and lower sealing rib 183 formed inside the inner cylindrical wall 172 of the ferrule 170 both seal against the outer surface of the spike member 104.

The inner container 111 remains in the position shown in FIG. 5*c* until a user releases the closure 152 from the bottle 150. When this occurs, the inner container 111 moves to the position shown in FIG. 5*d*. In this position the upper sealing rib 182 becomes unsealed from the spike member 104, but the lower sealing rib 183 remains in sealing contact with the outer surface of the spike member, below the apertures 108. This leaves an escape passage for the compressed liquid 115 (or gas 116), which is forced out of the container 111 by the pressurized gas 116 in the direction of arrows 184, 185, 186, between the spike member 104 and ferrule 170, through the radial passages 108 and into the dip tube 130. The liquid 115 or gas 116 then passes through the dip tube 130, expelling the concentrate or additive material 131 in the dip tube 130 through valve 300 into the liquid or other substance contained in the bottle 150. Possible embodiments of the valve are described in more detail below with reference to FIGS. 11 to 21. On removal of the closure 152, the inner container 111 and ruptured ferrule 170 are removed from the bottle 150 together, as shown in FIG. 5*e*, leaving the insert 100 and dip tube 130 in the bottle. The insert does not impede pouring of the liquid in the bottle, which can flow between the support legs 190 of the insert 100.

FIGS. 8*a* to 8*e* show another embodiment of the invention in which the insert is adapted to house four dip tubes. The embodiment functions in the same way as that shown in FIGS. 5*a* to 5*e*, and the same reference signs are used to denote items which are identical in both embodiments. The hollow spike member 104 is replaced by a rupturing member 200 which has a hollow spike portion 204, a small diameter bore portion 205, a tapering chamber portion 206, a lower end cap 207, radial passages 208 in the wall of the small diameter bore portion 205, and four dip tubes 230*a–d*.

The dip tubes, typically comprising polypropylene drinking straws or similar, may be of different diameter or length and may contain different predetermined doses of additives 231*a–d*, and are each provided with a valve 300 at the lower end. Possible embodiments of the valve are described in more detail below with reference to FIGS. 11 to 21. The lower end cap 207 is provided with apertures and one-way cone washers for simple, sealable insertion of the dip tubes.

The invention can be used with fragrances, flavouring, pharmaceuticals (particularly suitable because of the accurate dosage obtainable), chemicals, vitamins etc. By using several different tubes of different length exiting at different levels in the liquid, different colored or flavored bands within the liquid can be obtained. The tubes can be filled precisely at a different location and then inserted into the housing 1 at the point of filling the bottles. Compressed air or other gas is particularly suitable as a propellant for powdered or granulated solids, so that liquid does not cause the solids to adhere to the side of the dip tube.

FIGS. 11 to 14 show a first embodiment of the valve 300 provided at the lower end of the dip tube 130. The lower end of the dip tube 130 is provided with a series of ribs or corrugations 310, which allow the overall length of the dip tube to expand and contact by a concertina type action. The bottom of the dip tube is sealed 335, for example by heating and twisting the dip tube, or by any other suitable means.

A sleeve 312, whose internal diameter is slightly greater than the external diameter of the ribs 310, has an inwardly projecting return flange 314 at its upper end. This flange 314 engages with the first rib 310*a* of the series of ribs 310. The lowest rib 310*z* has a larger external diameter than the other ribs, so that in the folded or contracted state, as shown in FIGS. 12 and 13, the rib 310*z* is in resilient contact with the lower end of the sleeve 312. A number of apertures 318 are provided in the upper portion 320 of the lower rib 310*z*, although it is to be understood that the invention may function equally well if the apertures 318 are instead provided in another rib 310, near the lower end of the corrugated portion. The apertures should be near the lower end of the dip tube 130, in order to minimize wastage, since any liquid 131 in the dip tube below the apertures 318 will not be expelled through the apertures 318 when internal pressure is applied to the dip tube. FIGS. 13 and 14 show two apertures, on opposite sides of the dip tube 130, but in practice any number of apertures 318 may be provided. When the corrugated portion of the dip tube 130 is in the unexpanded state, the ribs 310 are in close contact with each other, so that the apertures 318 are effectively closed by contact with the adjacent rib 310.

When the cap 152 is removed from the bottle 150, compressed gas 116 is allowed to escape from the chamber 111, through the radial passages 108 and into the dip tube 130, as explained above with reference to FIGS. 5*a* to 5*e*. The pressurized gas forces the internal pressure in the dip tube 130 to be higher than that in the bottle 150, with the result that the corrugated portion of the dip tube expands.

As the lower rib 310*z* expands past the lower edge 322 of the sleeve 312, it is free to unfold, and the apertures 318 are no longer closed by close contact with the adjacent rib. The liquid 131 in the dip tube is then forced out of the apertures 318 under pressure in the direction of arrows 324. In this way no leakage of the liquid 131 in the dip tube 130 can occur from the dip tube to the surrounding liquid in the bottle 150 until the interior of the dip tube 130 is pressurized upon removal of the cap.

In a further embodiment, the sleeve 312 may be omitted, if the plastic of the dip tube 130 has sufficient plastic "memory", ie if the corrugations remain closely packed when the dip tube is unpressurized, so that the apertures remain blocked off by close contact with an adjacent rib until such time as the interior of the dip tube 130 is pressurized, and the corrugations expand.

FIGS. 15 and 16 illustrate a further embodiment of a valve 300 according to the invention. The lower end of the dip tube 130 is sealed by the addition of a concave insert 330, bonded to the interior wall of the dip tube 130. The concave form is selected so that deformation of the insert 330 is resisted when the interior of the dip tube is pressurized. Alternatively the bottom of the dip tube 130 may be sealed by heating and/or twisting 335, as shown in FIGS. 13 and 14.

Adjacent to the lower end of the dip tube 130 is provided a tubular section 332 of uniform diameter, and above that a corrugated section 334 having a series of ribs or corrugations 340, which allow the overall length of the dip tube to expand and contact by a concertina type action.

A sleeve 342 has an upper portion 344, whose internal diameter is greater than the external diameter of the ribs 340, and a lower portion 346, whose internal diameter is just greater than the outside diameter of the tubular section 332 of the dip tube 130. The top of the sleeve 342 has an inwardly projecting return flange 348 at its upper end. This flange 348 engages with the first rib 340*a* of the series of ribs 340. A number of apertures 350 are provided in the tubular section 332, near the bottom of the dip tube 130. FIGS. 15 and 16 show two apertures, on opposite sides of the dip tube 130, but in practice any number of apertures 350 may be provided. The apertures 350 should be as low as possible, to minimize product wastage. When the corrugated portion 334 of the dip tube 130 is in the unexpanded state, as shown in FIG. 15, the apertures 350 are effectively closed by contact with the adjacent sleeve portion 346.

When the cap 152 is removed from the bottle 150, compressed gas 116 is allowed to escape from the chamber 111, through the radial passages 106 and into the dip tube 130, as explained above with reference to FIGS. 5*a* to 5*e*. The pressurized gas forces the internal pressure in the dip tube 130 to be higher than that in the bottle 150, with the result that the corrugated portion of the dip tube expands and adopts the position shown in FIG. 16.

As the apertures 350 move as a result of the expansion past the lower edge 352 of the sleeve 344, the apertures 350 are no longer closed by close contact with the sleeve. The liquid 131 in the dip tube is then forced out of the apertures 350 under pressure in the direction of arrows 354. In this way no leakage of the liquid 131 in the dip tube 130 can occur from the dip tube to the surrounding liquid in the bottle 150 until the interior of the dip tube 130 is pressurized upon removal of the cap.

FIGS. 17 to 21 show five different embodiments of the valve 300 provided at the lower end of the dip tube 130. In all cases the material 131 is held in the dip tube by the flattened end portion of the dip tube, and cannot exit from the dip tube until the dip tube is pressurized, causing the flattened end portion to open.

In the first embodiment of FIG. 17 the lower end of the dip tube 130 is provided with a flattened, duck bill shaped end portion 401. This arrangement requires a significant internal pressure before the valve will open, since the natural spring action of the inner wall 402 means it must "pop" open away from outer wall 403.

In the second embodiment of FIG. 18 the lower end of the dip tube 130 is provided with a simple, planar, flattened end portion 411. The heating action means that the two walls 412, 413 are in equilibrium in the closed position.

In the third embodiment of FIG. 19 the flattened end portion 421 is folded back on itself, to provide a more secure closure. A high internal pressure is required, first to expand the upper portion 422 of the flattened end portion 421, and then to cause the fold 423 to straighten out, before the lower portion 424 can expand. The heating action means that the fold 423 is in equilibrium in the folded position.

The fourth embodiment of FIG. 20 is similar to that shown in FIG. 19, except that there are three folds 432 provided in the flattened end portion 431. Two or four or more folds may be provided if required.

In the fifth embodiment of FIG. 21 the flattened end portion 441 is rolled in a coil, which unrolls upon the application of internal pressure to the dip tube 130.

Modifications and improvements may be incorporated without departing from the scope of the invention.

I claim:

1. An apparatus for introducing a component into a first liquid, the apparatus comprising:

a first container for holding the first liquid having an opening closeable by a releasable closure, a second container containing pressurized propellant fluid located in the first container, and a conduit having a first end communicating with the second container and a second end communicating with the first container;

wherein the conduit contains an additive which is expelled from the conduit into the first liquid by the entry of the propellant fluid into the conduit on release of the releasable closure.

2. An apparatus according to claim 1, wherein the second container comprises an outer housing and an inner container containing the propellant fluid, the inner container being movably mounted in the outer housing for movement between a closed position in which the inner container is sealed by the outer housing when the releasable closure closes the opening, and an open position in which the propellant fluid within the inner container is released from the inner container into the conduit on release of the releasable closure.

3. An apparatus according to claim 2, wherein the inner container includes a rupturable member and the outer housing includes a rupturing member to rupture the rupturable member on the inner container.

4. An apparatus for introducing a component into a first liquid, the apparatus comprising:

a first container for holding the first liquid having an opening;

a releasable closure adapted to close said opening; and an insert located adjacent to said opening;

wherein the releasable closure comprises an integral closure container containing a propellant fluid;

wherein said insert comprises a first chamber for receiving said integral closure container and a hollow rupturing member extending into said first chamber and defining a second chamber inside said rupturing member;

wherein said first chamber is provided with openings to allow the passage of said first liquid through said insert;

wherein said closure container includes a rupturable member adapted to be ruptured by said rupturing member; and wherein the apparatus further comprises a conduit having a first end communicating with the second chamber and a second end communicating with the first container, the conduit containing an additive which is expelled from the conduit into the first liquid by the entry of the propellant fluid into the conduit on release of the releasable closure.

5. An apparatus according to claim 4, wherein said closure container comprises a substantially tubular wall portion extending from said closure and a cap member sealingly fitted to said wall portion to form said closure container, wherein said cap member comprises said rupturable member.

6. An apparatus according to claim 5, wherein on closing of the first container by the closure, the closure container is moved towards the rupturing member, such that when the closure container is in the closed position, the rupturable member is ruptured by the rupturing member and the contents of the closure container are prevented from being released from the closure container by the sealing action between the rupturing member and the cap member.

7. An apparatus according to claim 4, wherein the conduit extends below the surface of the first liquid in the first container.

8. An apparatus according to claim 4, wherein the propellant fluid comprises a pressurized gas or a gas/liquid mixture.

9. An apparatus according to claim 4, wherein the conduit contains a number of additives arranged at different positions along the length of the conduit.

10. An apparatus according to claim 4, wherein the additive is a liquid or solid in pourable form.

11. An apparatus according to claim 4, wherein the additive is a product selected from the following: coloring agents, flavoring agents, fragrances, pharmaceutical components, chemicals, nutrients, liquids containing gases in solution.

12. An apparatus according to claim 4, comprising two or more conduits, each having a first end communicating with the second container and a second end communicating with the first container.

13. An apparatus according to claim 4, wherein each conduit comprises a plastic tube of circular cross-section.

14. An apparatus according to claim 4, wherein each conduit comprises a tube of internal dimensions sufficiently small to prevent the first liquid entering the conduit through the second end of the conduit.

15. An apparatus according to claim 4, wherein each conduit is provided with a valve at the second end of the conduit remote from the second container.

16. An apparatus according to claim 15, wherein the valve comprises an expandable tubular member and a sleeve member surrounding at least a portion of said expandable tubular member, wherein the expandable tubular member has a closed end and at least one aperture adjacent to the closed end adapted to permit the expulsion of fluid under pressure from the expandable tubular member, and is expandable between a first unexpanded sate in which the aperture is closed by contact with either the sleeve or a part of the expandable tubular member and a second expanded state in which the aperture is open.

17. An apparatus according go claim 16, wherein the expandable tubular member comprises a corrugated portion adapted to concertina between said unexpanded and expanded states.

18. An apparatus according to claim 16, wherein the aperture is provided in a concertina-like rib of said corrugated portion.

19. An apparatus according to claim 16, wherein the aperture is provided in a uniform diameter portion of the expandable tubular member, and the sleeve comprises an upper portion of larger diameter which fits around the corrugated portion of the expandable tubular member and a lower portion of smaller diameter which fits sealingly around the uniform diameter portion of the expandable tubular member.

20. An apparatus according to claim 15, wherein the valve comprises a hollow tubular member having a fattened end portion of resilient plastics material, the flattened end portion comprising two opposing walls held in contact with each other by the resilience of the plastics material and adapted to move out of contact with each other when the hollow tubular member is subject to internal pressure.

21. A method of introducing an additive in the form of a liquid or granulated solid into a liquid, comprising:

introducing a predetermined quantity of the additive into a conduit at least partially closed at one end and communicating with a container containing pressurized propellant fluid at the other end, installing the conduit and container in a vessel containing the liquid, closing the vessel with a releasable closure, and removing the releasable closure so that the liquid in the vessel is at atmospheric pressure, thereby forcing the pressurized propellant fluid from the container into said conduit so as to open the at least partially closed end of the conduit and expel the additive from the at least partially closed end of the conduit into the liquid.

* * * * *